US005379013A

United States Patent [19]

Coudert

[11] Patent Number: 5,379,013

[45] Date of Patent: Jan. 3, 1995

[54] MOLDED CASE CIRCUIT BREAKER WITH INTERCHANGEABLE TRIP UNITS

[75] Inventor: Patrick Coudert, Eybens, France

[73] Assignee: Merlin Gerin, France

[21] Appl. No.: 120,762

[22] Filed: Sep. 15, 1993

[30] Foreign Application Priority Data

Sep. 28, 1992 [FR] France ..... 92 11573

[51] Int. Cl.[6] ..... H01H 73/12

[52] U.S. Cl. ..... 335/17; 335/202

[58] Field of Search ..... 335/8-10, 335/202, 17

[56] References Cited

U.S. PATENT DOCUMENTS 3,112,385 11/1963 Thomas .
4,187,482 2/1980 Kosup .
5,075,659 12/1991 Morgan et al. ..... 335/17
5,252,937 10/1993 Bernier et al. ..... 335/202

FOREIGN PATENT DOCUMENTS 2121821 8/1972 France .
2091505 7/1982 United Kingdom .

*Primary Examiner*—Lincoln Donovan
*Attorney, Agent, or Firm*—Parkhurst, Wendel & Rossi

[57] ABSTRACT

A molded case circuit breaker with interchangeable trip units has on its front face a frame protruding out from the front panel of the circuit breaker, and surrounding the circuit breaker operating handle. The frame has a window in which the end of a bracket support is inserted fixedly secured to the trip unit, when the latter is in place. An inscription, notably of the rating of the trip unit, is borne by a face of the bracket support so as to be visible at all times, even when a front protection plate covers the trip unit.

2 Claims, 3 Drawing Sheets

MOLDED CASE CIRCUIT BREAKER WITH INTERCHANGEABLE TRIP UNITS

BACKGROUND OF THE INVENTION

The invention relates to a molded case circuit breaker comprising a front panel an orifice arranged in the front panel, a pivoting manual operating handle passing through the orifice and protruding out from said front panel, a surround in the form of a frame protruding out from the front panel and surrounding the orifice, an interchangeable trip unit for automatic opening of the circuit breaker in the event of a fault, and an indicating means, for indicating the trip unit rating.

A state-of-the-art circuit breaker of the kind referred to can be equipped with different trip units, notably with trip units of different ratings, the units being able to be electronic or electromagnetic trip units. The rating or characteristics of the trip unit are inscribed on the front part enabling the fitter or user to check the characteristics of the circuit breaker. Circuit breakers and other electrical devices are generally housed and grouped in electrical cabinets, themselves equipped with a front protection panel, leaving only the operating devices, i.e. the circuit breaker operating handle, accessible. The front protection panel covers the trip unit and the corresponding inscriptions, only removal of the front protection panel enabling the circuit breaker characteristics to be read and checked. It is possible to make an orifice in the front protection panel opposite the inscription, but this operation is complicated and correct positioning of the orifice is not guaranteed. The object of the present invention is to achieve a circuit breaker with an interchangeable trip unit, wherein the characteristics of the trip unit associated with the circuit breaker are visible under all circumstances.

SUMMARY OF THE INVENTION

The circuit breaker according to the invention is characterized in that the surround comprises a window, and that the trip unit comprises a support for the indicating means, arranged to cooperate with the window when the trip unit is in place to make the indicating means visible on the surround and the front panel.

The surround in the form of a frame notably serves the purpose of centering the front protection panel with respect to the circuit breaker. The opening arranged in the front protection panel for passage of the handle must allow free movement of this handle, and for this purpose this opening is of a size corresponding to the surround frame, so as to mount flush on the latter and to center the opening with respect to the handle. Any relative displacement liable to hamper actuation of the handle is thus prevented. By moving the rating indication onto the surround frame, this indication remains visible after the front protection plate has been fitted and thus enables subsequent checking. The surround frame advantageously bears other indications, notably of the open or closed position of the handle, or of other controls or settings of the circuit breaker.

The inscription of the trip unit rating is preferably borne on the end of a bracket support, securedly united to the trip unit, which bracket support is arranged to face the window arranged in the surround frame to make the inscription viisible through said window. The end of the bracket support is advantageously inserted without clearance in the window and is flush with the latter to ensure continuity of the surround in the form of a frame. The trip unit casing and the bracket support are made of a single part and any assembly error is thus excluded. It is however conceivable to manufacture these components in two parts, providing error prevention systems preventing any assembly error.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
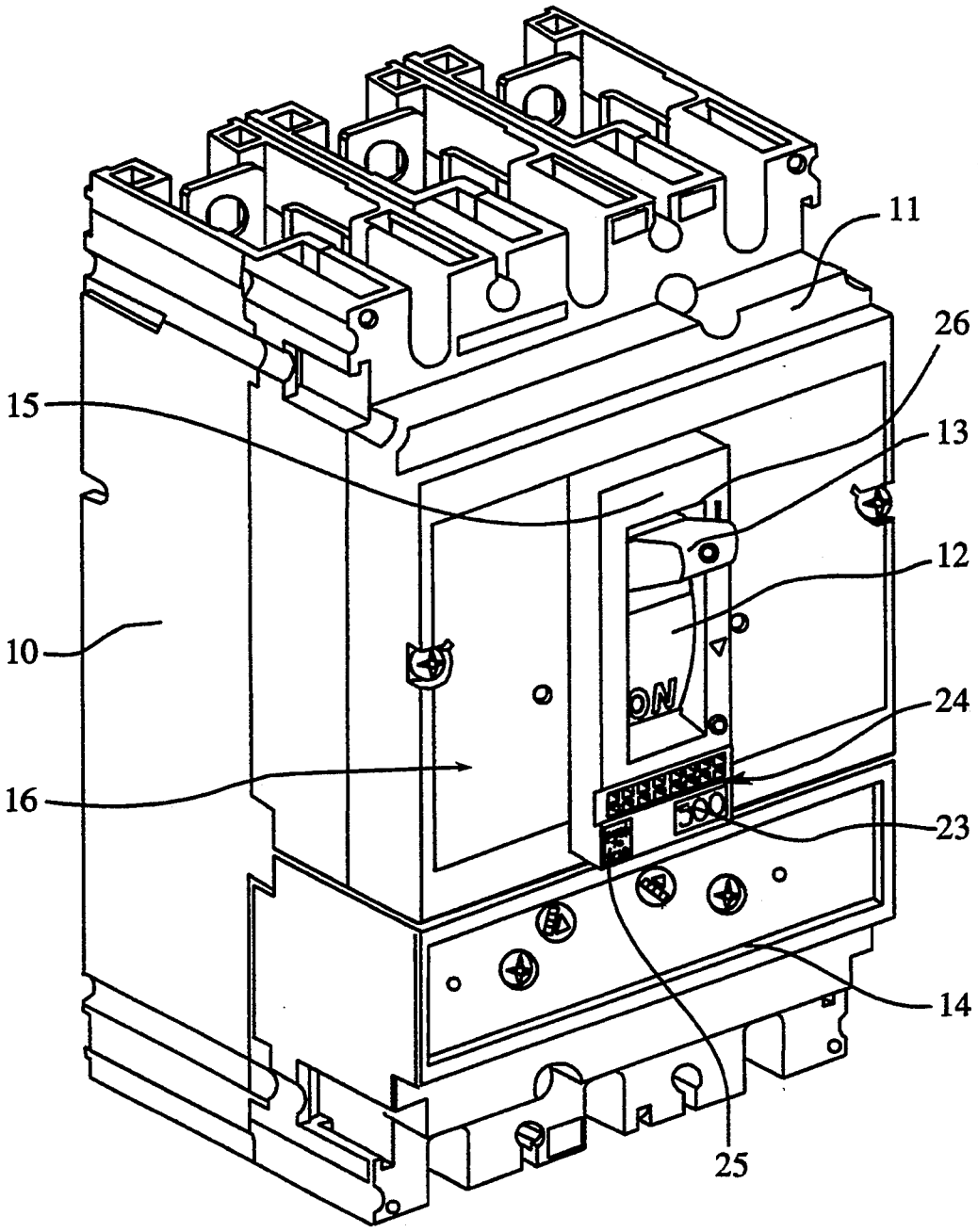
FIG. 1 is a schematic perspective view of a circuit breaker according to the invention.
Figure 2:
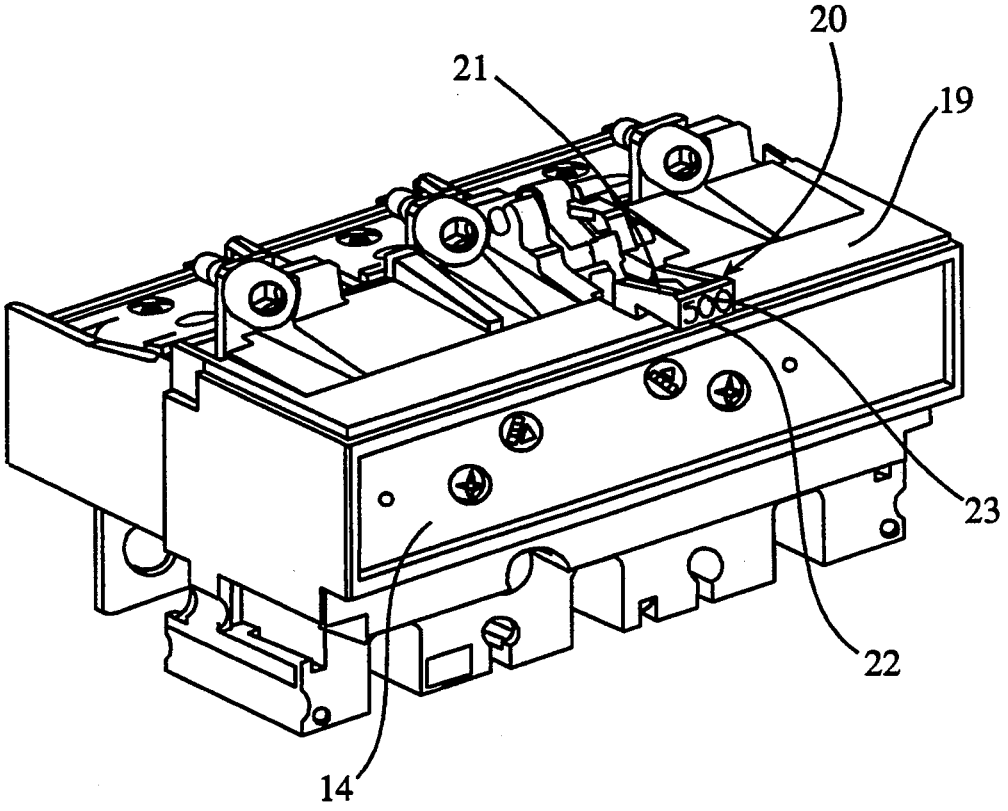
FIG. 2 is a perspective view of the trip unit of the circuit breaker according to FIG. 1.
Figure 3:
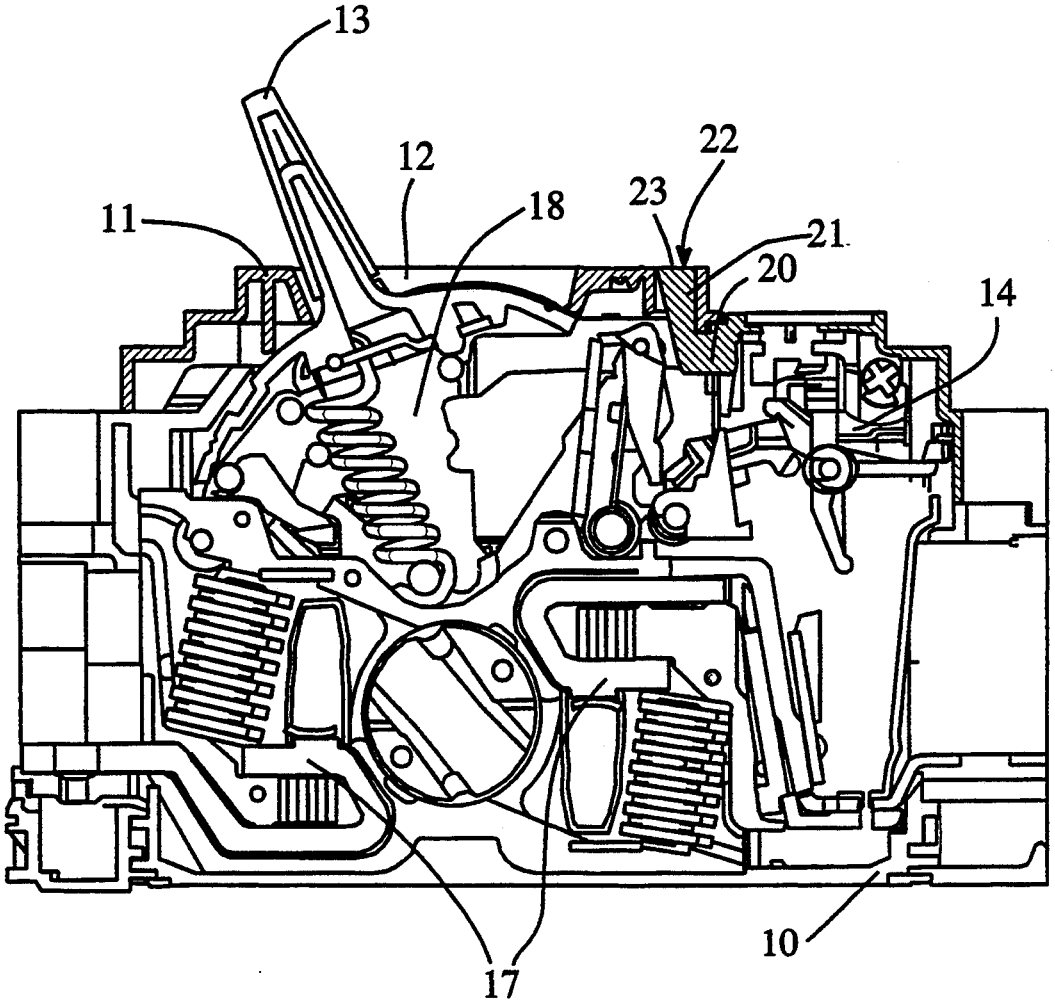
FIG. 3 is an elevational cross-sectional view of the circuit breaker according to FIG. 1.

In the drawings, a circuit breaker comprises a molded case 10, in several parts, notably with a cover 11 presenting an orifice 12 for passage of a manual operating handle 13 of the circuit breaker. A trip unit 14, notably electronic, is incorporated in or adjoined to the molded case 10 to bring about automatic opening of the circuit breaker in the event of a fault. The trip unit 14 is interchangeable and each switchgear unit has associated with it a range of trip devices corresponding to different ratings. The circuit breaker is customized on installation, by associating with it a trip unit 14 of suitable rating for the protection required. The rectangular-shaped orifice 12 for movement of the handle 13 is surrounded by a surround 15, in the form of a rectangular frame, protruding out from the front panel 16 of the cover 11. This protruding surround 15 contributes to strengthening the cover 11 in this zone and performs centering of a protection plate (not represented), fitted on the front panels of the switchgear units, and having windows fitting onto the protruding surrounds. Only the handle 13 and surround 15 in the form of a frame remain accessible, all the other parts, notably the live parts, being covered by the protection plate. The surround in the form of a frame prevents any relative displacement of the protection plate with respect to the handle 13, and thus ensures free pivoting of the latter. A circuit breaker of this kind which comprises breaking contacts 17 and an operating mechanism 18 of these contacts 17 is well-known and for example described in French Patent application n° 921,486 filed on Feb. 7, 1992 by the applicant, to which application the reader should advantageously refer for further details.

The casing 19 of the trip unit 14, made of molded plastic material, presents a bracket support 20 cast with this casing. The free end 21 of the bracket support 20 has a face 22 which bears an inscription 23, for example the trip unit rating. The surround 15 in the form of a frame bears a window 24 conjugate shape to that of the front face 22 of the bracket support 20, notably rectangular-shaped, and the assembly is arranged in such a way that in the assembled position of the trip unit 14, the front face 22 with the inscription 23 appears in the window 24. This front face advantageously occupies the whole window 24 and is flush with the surround 15. In the example illustrated by the drawings, the cover 11 is assembled last and the window 24 fits onto the end 21 of the bracket support 20, but it should be noted that other arrangements are conceivable, notably a system for fixing the trip unit enabling the free end 21 of the bracket support 20 to be inserted in the window 24 when the trip unit is assembled. The front face 22 can also remain further back and simply be facing the window 24 to enable the inscription 23 to be read from the front of the circuit breaker. It is also possible to use a bracket support associated with the trip unit 14, but independent from the latter, this bracket support comprising error preventors for preventing the window 24 from being fitted on a bracket support 20 not corresponding to the trip unit 14 fitted on the circuit breaker. The device is particularly simple and any assembly error is excluded. The protruding surround 15 in addition bears a button 25 for tripping the circuit breaker and other inscriptions 26, notably of circuit breaker opening and closing.

The invention is applicable to any molded case circuit breaker with interchangeable trip units, and is not limited to a form of inscription or to a type of inscription.

I claim:

1. A molded case circuit breaker having a circuit with separable contacts, comprising:

a front panel having an orifice formed through said front panel;

a pivoting manual operating handle passing through said orifice and protruding through said front panel;

an interchangeable trip unit for automatic separation of the contacts in the event of a fault;

indicating means for indicating a rating of said trip unit, said indicating means comprising a bracket support fixed to said trip unit, said bracket support having an end face bearing an identifying mark to indicate the rating of the trip unit, said bracket support protruding through the plane of said front panel; and a frame surrounding said orifice, said frame protruding from said front panel and comprising an aperture, said end face of said bracket support being positioned to be substantially flush with said frame and to substantially fill said aperture such that said identifying mark is visible through said aperture.

2. The molded case circuit breaker of claim 1, wherein said identifying mark is comprised of an inscription.

* * * * *